US012268284B2

(12) United States Patent
Kaija

(10) Patent No.: US 12,268,284 B2
(45) Date of Patent: Apr. 8, 2025

(54) ADJUSTABLE RING

(71) Applicant: HUAWEI TECHNOLOGIES CO., LTD., Shenzhen (CN)

(72) Inventor: Jyri Kaija, Kista (SE)

(73) Assignee: Huawei Technologies Co., Ltd, Shenzhen (CN)

( * ) Notice: Subject to any disclaimer, the term of this patent is extended or adjusted under 35 U.S.C. 154(b) by 0 days.

(21) Appl. No.: 18/681,433

(22) PCT Filed: Aug. 6, 2021

(86) PCT No.: PCT/EP2021/071989
§ 371 (c)(1),
(2) Date: Feb. 5, 2024

(87) PCT Pub. No.: WO2023/011726
PCT Pub. Date: Feb. 9, 2023

(65) Prior Publication Data

US 2024/0349851 A1 Oct. 24, 2024

(51) Int. Cl.
*A44C 9/02* (2006.01)
*A44C 9/00* (2006.01)

(52) U.S. Cl.
CPC ..... *A44C 9/02* (2013.01); *A44C 9/0053* (2013.01)

(58) Field of Classification Search
CPC ..... A44C 9/02; A44C 9/0053; A44C 9/00; A44C 5/00; A44C 5/0084; A44C 5/0092; A44C 5/246
USPC ..... 63/15.45, 15.5, 15.65
See application file for complete search history.

(56) References Cited

U.S. PATENT DOCUMENTS

| | | | | |
|---|---|---|---|---|
| 3,693,376 | A * | 9/1972 | Willner | A44C 17/0225 63/29.1 |
| 2009/0056373 | A1* | 3/2009 | Czajka | A44C 9/02 63/3 |
| 2014/0326022 | A1* | 11/2014 | Tosyal | A44C 27/00 63/15.1 |
| 2018/0338587 | A1* | 11/2018 | Ghanimian | A44C 9/02 |
| 2018/0352916 | A1* | 12/2018 | Zuluaga Escobar | A44C 9/02 |

* cited by examiner

*Primary Examiner* — Jack W Lavinder
(74) *Attorney, Agent, or Firm* — Leydig, Voit & Mayer, Ltd.

(57) ABSTRACT

A wearable electronic apparatus includes an inner ring that is configured to be in direct contact with a user and the inner ring is split to define a first inner ring end and a second ring end. A link element is configured to connect the first inner ring end and the second inner ring end. An outer ring is arranged around and in contact with the inner ring, where the outer ring is adjustable in diameter between a plurality of size settings. A housing structure for housing electronic components, where the housing structure is arranged to at least partially surround the inner ring and the outer ring.

17 Claims, 2 Drawing Sheets

ADJUSTABLE RING

CROSS-REFERENCE TO RELATED APPLICATIONS

This application is a National Stage of International Application No. PCT/EP2021/071989, filed on Aug. 6, 2021, which is hereby incorporated by reference in its entirety

FIELD

The disclosure relates to a wearable electronic apparatus comprising a ring assembly and a housing structure, in particular to a smart ring, which may be adjusted to fit a variety of finger sizes.

BACKGROUND

A common problem with wearable electronic apparatuses, in particular smart rings, is that the size of the human hand can fluctuate from a variety of factors ranging from extremely cold weather or warm weather to weight gain. Thus, a smart ring that has one fixed diameter may fit comfortably one day, but can become uncomfortably tight or loose the next. This is particularly undesirable for activity tracking smart rings, which have to be worn every day to provide useful metrics. In addition, a large variation also exists in finger diameters of different persons, which can range in size from 0000 (9.91 mm in diameter) to 13 (22.33 mm in diameter) or even larger, in ⅛ or ¼ increments between sizes.

One approach in trying to solve this problem is manufacturers asking customers to measure their finger size, and providing best fitting rings from existing stock, or in some cases manufacturing custom-sized smart rings based on such measurements by individual customers. As a result, smart ring manufacturers must manufacture and stock a variety of sizes of these devices with dedicated hardware to meet the demands of various customers. This generates costs for both the manufacturers and retailers alike since one or both must absorb the costs of unsold merchandise.

Furthermore, this approach still does not overcome the problem of ring size fluctuations of one particular user.

In some cases, ring sizes may be enlarged by use of a special expanding device and inserts of different sizes. However, this solution requires trained professionals and can also result in the hardware elements being damaged.

Other solutions include flexible bands holding a housing portion, however these solutions cannot provide a sufficiently stable and secure fit for such wearable devices that include sensors which need to be kept in a particular place on the finger in order to provide useful metrics.

Hence, the inventors have recognized that there is a need for providing a wearable electronic apparatus, which can be adjusted, preferably by the users themselves, to accurately fit a variety of finger sizes, while also providing sufficient stability for the hardware elements on the finger of a user.

SUMMARY

In accordance with an embodiment, the present disclosure provides an improved wearable electronic apparatus.

According to a first aspect, there is provided a wearable electronic apparatus a wearable electronic apparatus comprising an inner ring configured to be in direct contact with a user and split to have a first inner ring end and a second inner ring end and an outer ring arranged around and in contact with the inner ring. A link element is configured to connect the first inner ring end and a second inner ring end, and the outer ring is adjustable in diameter between a plurality of size settings. The apparatus also comprises a housing structure for housing electronic components, arranged to at least partially surround the inner ring and the outer ring.

This configuration enables one wearable apparatus to be accurately adjusted for various sizes through the split of the inner ring and by setting size with the outer ring, while still providing a stable and reliable fit for the electronic components included in the housing structure through the double ring structure. This results in significant reduction of size variants needed on the manufacturing side, and increased comfort and usability on the user side that leads to a better user experience.

In an embodiment, the inner ring is made of a resilient metal material, allowing the inner ring size to be adjusted by increasing or decreasing the distance between its ring ends, while still enabling a simple one-piece structure.

In an embodiment, the outer ring is made of metal or plastic, in particular a flexible metal or plastic material, thereby allowing for more flexibility of adjustment between different size settings, while still enabling a simple one-piece structure.

In a possible implementation form of the first aspect, the inner ring is configured to be openable at the split, the distance between the first inner ring end and the second inner ring end at the split increasing when the inner ring is opened, and the outer ring is arranged to delimit the distance at the split to the extent of its current size setting. This enables to the apparatus to be adjustable in a simple, intuitive manner between specific size settings.

In an embodiment, the outer ring can be adjusted between a number of size settings. For example, the number of size settings can be N integer, while N can be between 2-5, preferably 3, allowing adjusting the diameter of the outer ring between 5-15 mm.

In a further possible implementation form of the first aspect, the housing structure comprises a first housing element arranged at least partially radially outwards from the outer ring, and a second housing element arranged at least partially radially inwards from the inner ring. The first housing element and the second housing element thereby define a cavity, which allows for accommodating a portion of the inner ring and the outer ring, resulting in a secure but adjustable connection between the rings and the housing structure.

In a further possible implementation form of the first aspect, the first housing element comprises a base element and a cover element arranged at least partially radially outwards from the base element. The base element and the cover element define an enclosure therebetween, enabling the housing electronic components.

In an embodiment, the electronic components comprise at least a battery and an electronic panel, such as a printed circuit board (PCB).

In a further possible implementation form of the first aspect, the link element is further configured to be connected through engagement means to the housing structure, in particular to the first housing element and/or the second housing element, thereby ensuring that the position of the inner ring is fixed with respect to the housing structure, disabling unwanted rotation of the inner ring with respect to the housing structure.

In a further possible implementation form of the first aspect, the engagement means are configured to allow rotation of the link element relative to the housing structure, in particular to the part of the housing structure it is connected to, such as the first housing element and/or the second housing element. This ensures that the inner ring can still open up while being connected to the housing structure in a non-rotating manner.

In an embodiment, the inner ring and the outer ring are arranged concentrically with the same radial center, and the engagement means are configured to allow rotation of the link element around an axis of rotation pointing towards the radial center, ensuring a symmetrical opening of the inner ring with respect to the outer ring.

In a further possible implementation form of the first aspect, the engagement means comprise a pin protruding from the link element configured to engage with a corresponding recess arranged in the housing structure, in particular the first housing element and/or the second housing element thereof, ensuring a symmetrical opening of the inner ring with respect to the housing structure.

In a further possible implementation form of the first aspect, the housing structure comprises a second housing element arranged at least partially radially inwards from the inner ring, and the pin is arranged protruding radially inwards from the link element to engage with a corresponding recess arranged in the second housing element. This ensures a secure and hidden connection between the inner ring and the housing structure.

In a further possible implementation form of the first aspect, the link element comprises a first recess and a second recess arranged on opposite sides of the engagement means. The inner ring comprises first pin arranged protruding from the first inner ring end, and a second pin arranged protruding from the second inner ring end. The first recess is configured to engage the first pin and the second recess is configured to engage the second pin, thereby ensuring a simple solution for symmetrical opening of the inner ring with respect to the outer ring and/or the housing structure.

In a further possible implementation form of the first aspect, the first recess and/or the second recess is an elongated recess configured to slidably engage the first pin and/or the second pin, respectively, further ensuring that upon opening of the inner ring, the inner ring ends can maintain a horizontal alignment, without any vertical offset.

In a further possible implementation form of the first aspect, the first recess, the first pin, the second recess, and the second pin are all arranged rotationally symmetrically with respect to a rotational axis of the engagement means, thereby only allowing the inner ring to open or close in a symmetrical manner, keeping the same the distance between the engagement means and the first inner ring end and the second inner ring end respectively.

In a further possible implementation form of the first aspect, the outer ring is split to define a first outer ring end and a second outer ring end. At least one of the first outer ring end and the second outer ring end comprises locking means configured to allow adjusting the diameter of the outer ring between a plurality of size settings in an open state, and to disable any change in diameter of the outer ring in a closed state.

In a further possible implementation form of the first aspect, the locking means comprise a plurality of first teeth arranged at the first outer ring end configured to engage a plurality of second teeth arranged at the second outer ring end, thereby providing a simple and intuitive solution for adjusting the diameter of the outer ring.

In a further possible implementation form of the first aspect, the inner ring comprises a first rim and a second rim, both rims arranged to protrude radially outwards from an outer surface of the inner ring and to define a channel therebetween. At least a portion of the outer ring is configured to slidably fit in the channel, thereby allowing rotation of the outer ring relative to the inner ring at least to a certain degree.

In a further possible implementation form of the first aspect, the outer ring is configured to be coaxially rotatable relative to the inner ring from a first position where the locking means are at least partially surrounded by the housing structure to second position where the locking means are at least partially exposed, thereby ensuring that the locking means can be hidden by the user when needed.

In a further possible implementation form of the first aspect, at least one of the inner ring and the outer ring are single-piece elements, thereby ensuring simple and cost-effective manufacturing and assembly, and longevity of the apparatus.

In a further possible implementation form of the first aspect, the wearable electronic apparatus is a smart ring or a bracelet, thereby providing a solution for adjustable size for these types wearable devices.

These and other aspects will be apparent from the embodiment(s) described below.

BRIEF DESCRIPTION OF THE DRAWINGS

In the following detailed portion of the present disclosure, the aspects, embodiments, and implementations will be explained in more detail with reference to the example embodiments shown in the drawings, in which.

DETAILED DESCRIPTION

Figure 1:
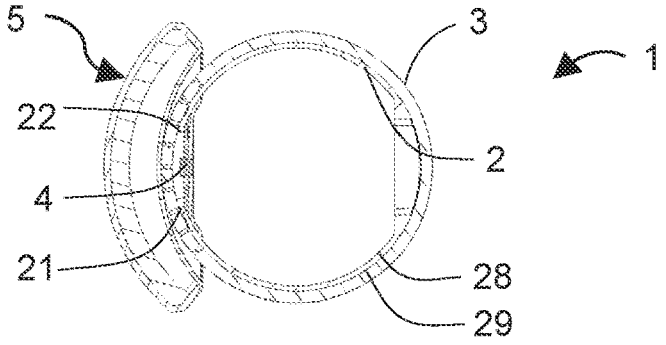
FIG. 1 shows a top cross-sectional view of a wearable electronic apparatus in accordance with an example of the embodiments of the disclosure.

FIG. 1 shows a wearable electronic apparatus 1 from the top, the apparatus 1 comprising an inner ring 2 and an outer ring 3 arranged around and in contact with the inner ring 2. The inner ring 2 is split to define a first inner ring end 21 and a second inner ring end 22 and is configured to be openable at the split, wherein the distance between the first inner ring end 21 and the second inner ring end 22 at the split increases when the inner ring 2 is opened.

This can be achieved e.g. by the inner ring 2 being manufactured from a resilient or elastic material, such as a resilient metal alloy, which is able to withstand elastic deformation without deforming plastically, thereby also ensuring that the inner ring 2 does not break or crack under stress of opening.

In an embodiment the inner ring 2 is configured as a spring, i.e. resiliently biased to expand and thus acting to increase the distance at the split between the first inner ring end 21 and the second inner ring end 22 unless constricted by another element. This property can be achieved in many ways known in the field, such as pre-stressing the inner ring 2 towards an elongated state during manufacture, i.e. by heat treatment.

A link element 4 is therefore also arranged to connect the first inner ring end 21 and a second inner ring end 22 and act as a constriction against the inner ring 2, delimiting the opening up of the inner ring 2 between the first inner ring end 21 and the second inner ring end 22.

The outer ring 3 is adjustable in diameter between a plurality of size settings and is arranged to further delimit the distance at the split of the inner ring 2 to the exact extent of its current size setting. This outer ring may also be made of a resilient or elastic material, such as a resilient plastic or metal.

Both the inner ring 2 and the outer ring 3 may be manufactured as single-piece elements.

A housing structure 5 is further provided in the apparatus 1 for housing electronic components. The housing structure 5 is arranged in a way that a portion of the assembly of the inner ring 2 and the outer ring 3 is surrounded by the housing structure 5, in other words the inner ring 2 and the outer ring 3 both protrude at least partially into or traverses through an opening in the housing structure 5.

The wearable electronic apparatus 1 may be any kind of apparatus suitable to be worn by a user, such as a smart ring or a bracelet. At least the inner ring 2 may be configured to allow the electronic apparatus 1 to be worn by a user, e.g., around an arm or a finger. The inner ring 2 may, in other words, have an inner surface 28 configured to be in contact with the skin of a user, the inner surface 28 e.g. forming a hollow cylinder, while an opposite outer surface 29 may be oriented radially outwards pointing away from the user.

Figure 2:
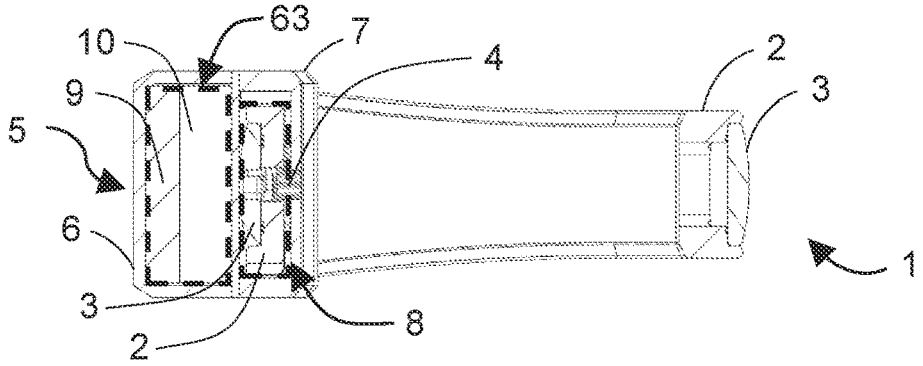
FIG. 2 shows a side cross-sectional view of a wearable electronic apparatus in accordance with an example of the embodiments of the disclosure.

As illustrated in the cross-section of the wearable electronic apparatus 1 in FIG. 2, the housing structure 5 may comprise a first housing element 6 arranged at least partially radially outwards from the outer ring 3, and a second housing element 7 arranged at least partially radially inwards from the inner ring 2. The first housing element 6 and the second housing element 7 thereby define a cavity 8 (shown with a dashed outline) for accommodating a portion of both the inner ring 2 and the outer ring 3. In other words, the inner ring 2 and the outer ring 3 both protrude at least partially into or traverses through the cavity 8 defined in the housing structure 5 between the first housing element 6 and the second housing element 7.

As further shown in FIG. 2, the housing structure 5 can comprise an enclosure 63 (also shown with a dashed outline) for housing electronic components, such as a battery 9 and an electronic panel 10, such as a printed circuit board (PCB).

Figure 6:
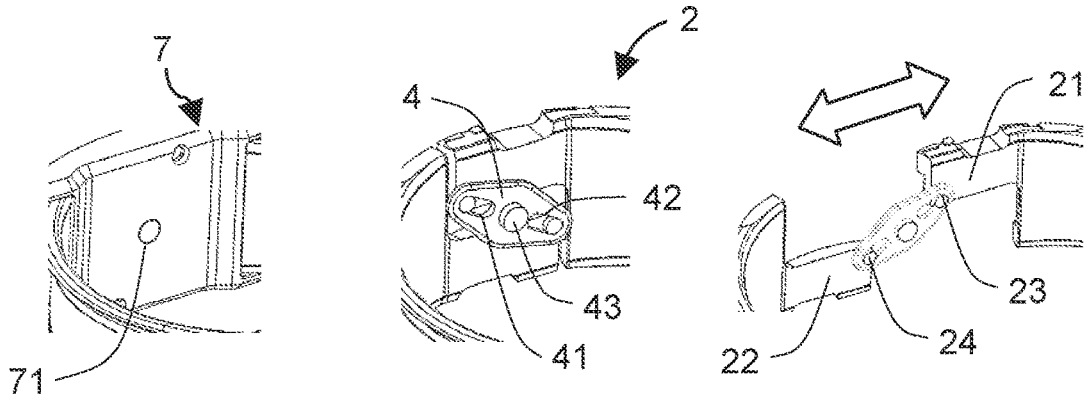
FIG. 6 shows partial isometric views of the link element and the opening sequence of the inner ring of the wearable electronic apparatus in accordance with an example of the embodiments of the disclosure.

FIG. 2 further illustrates the connection between the link element 4 and the housing structure 5, namely that the link element 4 may be connected to the second housing element 7 through engagement means 43 (shown in detail in FIG. 6), such as a pin protruding radially inwards from the link element 4 to engage with a corresponding recess 71 arranged in the second housing element 7 (also shown in detail in FIG. 6). The link element 4 may also or instead be connected to the first housing element 6, depending on the embodiment preferred.

Figure 3:
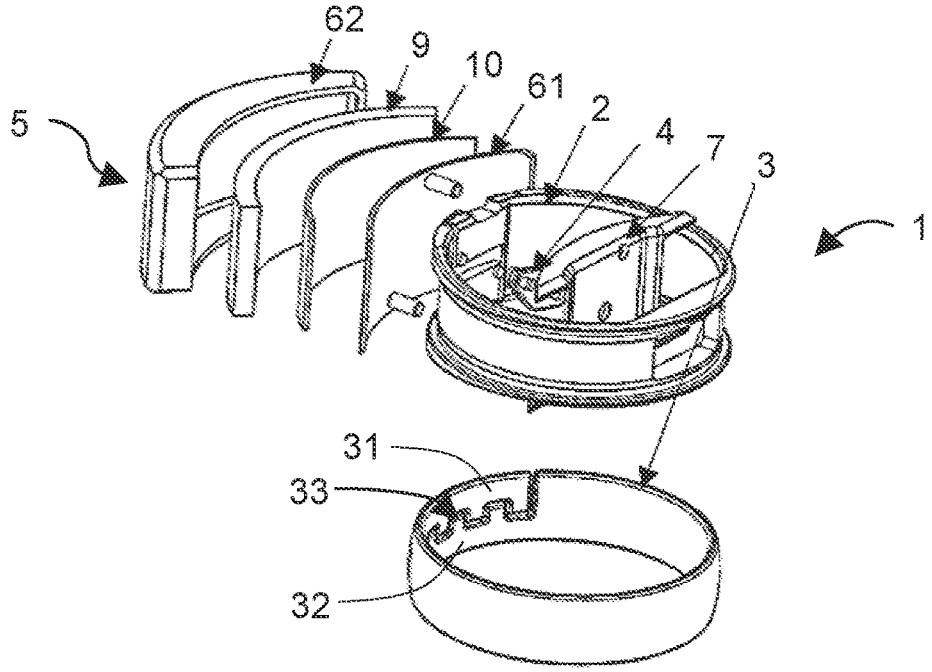
FIG. 3 shows an exploded isometric view of a wearable electronic apparatus in accordance with an example of the embodiments of the disclosure.

As illustrated in FIG. 3, the first housing element 6 of the housing structure 5 can comprise a base element 61 and a cover element 62, the cover element 62 being arranged at least partially radially outwards from the base element 61. This way the base element 61 and the cover element 62 can define the enclosure 63 therebetween for housing the electronic components, such as the battery 9 and the electronic panel 10.

As further shown in FIG. 3, the outer ring 3 is split to define a first outer ring end 31 and a second outer ring end 32. The first outer ring end 31 and the second outer ring end 32 may comprise locking means 33 configured to allow adjusting the diameter of the outer ring 2 between a plurality of size settings in an open state, and to disable any change in diameter of the outer ring 2 in a closed state. In the illustrated example, the locking means 33 comprise a plurality of first teeth 34 arranged at the first outer ring end 31, and configured to engage a plurality of second teeth 35 arranged at the second outer ring end 32, thereby allowing a plurality of size settings for the outer ring 3 and thereby the apparatus 1.

Accordingly, the outer ring 3 can be adjusted between a number of size settings. For example, the number of size settings can be N integer, while N can be between 2-5, preferably 3, allowing adjusting the diameter of the outer ring between 5-15 mm. In the illustrated example shown in FIG. 3, the outer ring 3 can be adjusted between 3 sizes (3 teeth in each outer ring end), wherein the illustrated example shown in FIG. 4, the outer ring 3 can be adjusted between 4 sizes, and in the illustrated example shown in FIG. 5, the outer ring 3 can be adjusted between 5 sizes.

Figure 4:
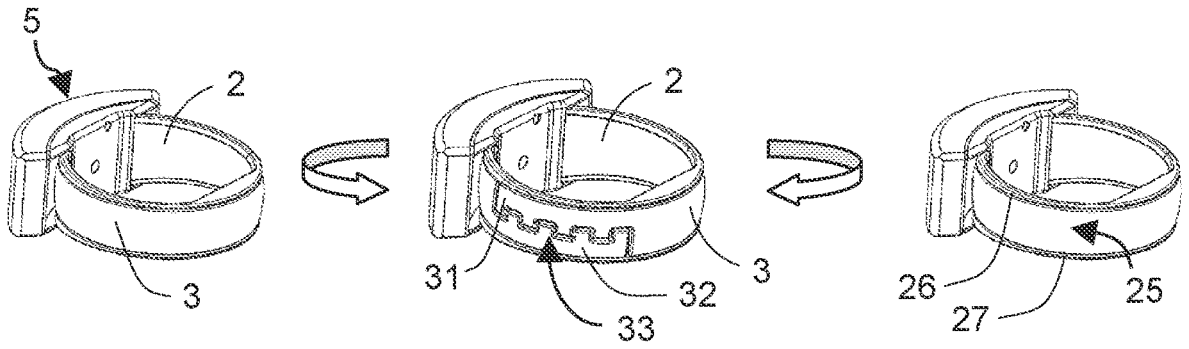
FIG. 4 shows isometric views of adjusting size of a wearable electronic apparatus in accordance with an example of the embodiments of the disclosure.

FIG. 4 illustrates through a series of isometric views how the size of the wearable electronic apparatus 1 may be adjusted by a user. In the first step, the apparatus 1 is shown in a first position where the locking means 33 surrounded by the housing structure 5 and thereby kept hidden. In the second step, the outer ring 3 is rotated relative to the inner ring 2 from a first position to second position where the locking means 33 are exposed and thus the size setting of the outer ring 3 can be adjusted, e.g. manually by the user. This is accompanied by the opening or closing of the inner ring 2, as will be illustrated in FIG. 6. Once the desired size is set on the outer ring 3 through the locking means 33, the outer ring 3 is rotated again relative to the inner ring 2 back from the second position to the first position where the locking means 33 are hidden again in the housing structure.

As further illustrated in the last view of FIG. 4, the inner ring 2 may comprise a first rim 26 and a second rim 27, both the first rim 26 and the second rim 27 arranged to protrude radially outwards from an outer surface 29 of the inner ring 2 and to define a channel 25 therebetween (as can be seen also in FIG. 2). In this way, the outer ring 3 is configured to slidably fit in the channel 25 allowing rotation of the outer ring 3 relative to the inner ring 2, as explained above.

Figure 5:
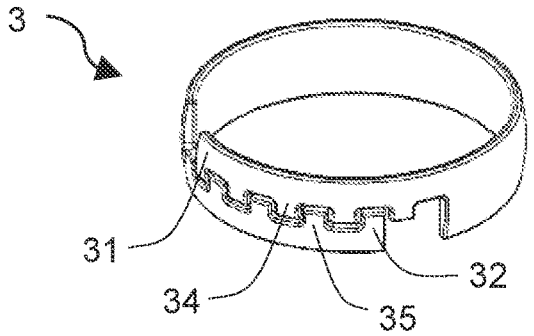
FIG. 5 shows an isometric view of the outer ring of a wearable electronic apparatus in accordance with an example of the embodiments of the disclosure.

FIG. 5 illustrates the locking means 33 of the outer ring 3, in particular that the outer ring 3 may comprise a plurality (e.g. between 2-5) of first teeth 34 arranged at the first outer ring end 31 configured to engage a corresponding plurality (e.g. between 2-5) of second teeth 35 arranged at the second outer ring end 32, which engagement can be manually set by the user between the different size settings.

Finally, FIG. 6 illustrates the opening and closing mechanism of the inner ring 2 through the link element 4. As shown in the illustrated example, the second housing element 7 comprises a recess 71 designed to correspond with and engage with a pin 43 arranged protruding radially inwards from the link element 4, as shown in the second view. This pin 43 is configured engage with the recess 71 to allow rotation of the link element 4 relative to the housing element 7.

The link element 4 in the illustrated example further comprises a first recess 41 and a second recess 42 arranged on opposite sides of the pin 43. Correspondingly, as shown in the third view, the inner ring 2 comprises first pin 23 arranged protruding from the first inner ring end 21, and a second pin 24 arranged protruding from the second inner ring end 22. When assembled, the first recess 41 engages the first pin 23 and the second recess 42 engages the second pin 24. As also shown in the illustrated example, at least one of the first recess 41 and the second recess 42 is preferably an elongated recess configured to slidably engage the first pin 23 or the second pin 24 respectively.

According to the illustrated example of FIG. 6, the first recess 41, the first pin 23, the second recess 42, and the second pin 24 are all arranged rotationally symmetrically with respect to a rotational axis of the engagement pin 43, thereby only allowing the inner ring 2 to open or close in a symmetrical manner, keeping the same the distance between the engagement means 43 and the first inner ring end 21 and the second inner ring end 22 respectively. This ensures that upon opening of the inner ring 2, the inner ring ends 21 and 22 can maintain a horizontal alignment, without any vertical offset, and that the inner ring 2 opens in a controlled, synchronized and symmetrical manner with respect to the outer ring 3 and the housing structure 5.

The various aspects and implementations have been described in conjunction with various embodiments herein. However, other variations to the disclosed embodiments can be understood and effected by those skilled in the art in practicing the claimed subject-matter, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The reference signs used in the claims shall not be construed as limiting the scope. Unless otherwise indicated, the drawings are intended to be read (e.g., cross-hatching, arrangement of parts, proportion, degree, etc.) together with the specification, and are to be considered a portion of the entire written description of this disclosure. As used in the description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The invention claimed is:

1. A wearable electronic apparatus, comprising:

an inner ring configured to be in direct contact with a user, the inner ring being split to define a first inner ring end and a second inner ring end;

a link element configured to connect the first inner ring end and the second inner ring end;

an outer ring arranged around and in contact with the inner ring, the outer ring being adjustable in diameter between a plurality of size settings; and a housing structure for housing electronic components, the housing structure arranged to at least partially surround the inner ring and the outer ring.

2. The wearable electronic apparatus according to claim 1, wherein the inner ring is configured to be openable at the split, wherein a distance between the first inner ring end and the second inner ring end at the split increases when the inner ring is opened, and wherein the outer ring is arranged to delimit the distance between the first inner ring end and the second inner ring end at the split to the extent of its current size setting.

3. The wearable electronic apparatus according to claim 1, wherein the housing structure comprises a first housing element arranged at least partially radially outwards from the outer ring, and a second housing element arranged at least partially radially inwards from the inner ring, and wherein the first housing element and the second housing element define a cavity therebetween for accommodating at least a portion of the inner ring and the outer ring.

4. The wearable electronic apparatus according to claim 3, wherein the first housing element comprises a base element, and a cover element arranged at least partially radially outwards from the base element, wherein the base element and the cover element define an enclosure therebetween for housing electronic components, and wherein the electronic components comprise at least a battery and an electronic panel.

5. The wearable electronic apparatus according to claim 4, wherein the link element is further configured to be connected to at least one of the housing structure, the first housing element, and the second housing element through engagement means.

6. The wearable electronic apparatus according to claim 5, wherein the engagement means are configured to allow rotation of the link element relative to at least one of the housing structure, the first housing element, and the second housing element.

7. The wearable electronic apparatus according to claim 6, wherein the engagement means comprise a pin protruding from the link element, configured to engage with a corresponding recess arranged in at least one of the housing structure, the first housing element, and the second housing element.

8. The wearable electronic apparatus according to claim 7, wherein the housing structure comprises the second housing element arranged at least partially radially inwards from the inner ring, and wherein the pin is arranged protruding radially inwards from the link element to engage with the corresponding recess arranged in the second housing element.

9. The wearable electronic apparatus according to claim 5, wherein the link element comprises a first recess and a second recess arranged on opposite sides of the engagement means, wherein the inner ring comprises a first pin arranged protruding from the first inner ring end, and a second pin arranged protruding from the second inner ring end, and wherein the first recess is configured to engage the first pin and the second recess is configured to engage the second pin.

10. The wearable electronic apparatus according to claim 9, wherein at least one of the first recess and the second recess is an elongated recess configured to slidably engage the first pin or the second pin respectively.

11. The wearable electronic apparatus according to claim 9, wherein the first recess, the first pin, the second recess, and the second pin are all arranged rotationally symmetrically with respect to a rotational axis of the engagement means, thereby only allowing the inner ring to open or close in a symmetrical manner, keeping the same the distance between the engagement means and the first inner ring end and the second inner ring end respectively.

12. The wearable electronic apparatus according to claim 1, wherein the outer ring is split to define a first outer ring end and a second outer ring end, and wherein at least one of the first outer ring end and the second outer ring end comprises locking means configured to allow adjusting the diameter of the outer ring between a plurality of size settings in an open state, and to disable any change in diameter of the outer ring in a closed state.

13. The wearable electronic apparatus according to claim 12, wherein the locking means comprise a plurality of first teeth arranged at the first outer ring end configured to engage a plurality of second teeth arranged at the second outer ring end.

14. The wearable electronic apparatus according to claim 12, wherein the outer ring is configured to be coaxially rotatable relative to the inner ring from a first position where the locking means are at least partially surrounded by the housing structure to a second position where the locking means are at least partially exposed.

15. The wearable electronic apparatus according to claim 1, wherein the inner ring comprises a first rim and a second rim, wherein both the first rim and the second rim are arranged to protrude radially outwards from an outer surface of the inner ring and to define a channel therebetween, and wherein at least a portion of the outer ring is configured to slidably fit in the channel allowing rotation of the outer ring relative to the inner ring at least to a certain degree.

16. The wearable electronic apparatus according to claim 1, wherein at least one of the inner ring and the outer ring are single-piece elements.

17. The wearable electronic apparatus according to claim 1, wherein the wearable electronic apparatus is a smart ring or a bracelet.

* * * * *